US006358165B1

(12) United States Patent
Davis

(10) Patent No.: US 6,358,165 B1
(45) Date of Patent: Mar. 19, 2002

(54) THROATLESS SQUASH RACQUET

(75) Inventor: Stephen J. Davis, New Hope, PA (US)

(73) Assignee: Benetton Sportsystem USA, Inc., Bordentown, NJ (US)

( * ) Notice: Subject to any disclaimer, the term of this patent is extended or adjusted under 35 U.S.C. 154(b) by 0 days.

(21) Appl. No.: 08/279,837

(22) Filed: Jul. 25, 1994

Related U.S. Application Data

(63) Continuation of application No. 08/004,173, filed on Jan. 13, 1993, now abandoned, which is a continuation of application No. 07/746,140, filed on Aug. 14, 1991, now abandoned, which is a continuation of application No. 07/601,038, filed on Oct. 23, 1990, now abandoned, which is a continuation of application No. 07/309,246, filed on Feb. 10, 1989, now abandoned, which is a continuation-in-part of application No. 07/186,971, filed on Apr. 15, 1988, now abandoned.

(51) Int. Cl.[7] ..... A63B 49/02

(52) U.S. Cl. ..... 473/537; 473/540; 473/543; 473/524

(58) Field of Search ..... 273/73 R, 73 C, 273/73 P, 73 G; 473/537, 540, 573, 527

(56) References Cited

U.S. PATENT DOCUMENTS

| | | | | |
|---|---|---|---|---|
| 1,132,214 A | * | 3/1915 | Reis et al. | |
| 1,609,662 A | * | 12/1926 | Rawlings et al. | 273/73 G |
| 1,637,583 A | * | 8/1927 | Nortyon | 273/73 D |
| 1,862,581 A | | 6/1932 | Robinson | |
| 2,969,984 A | * | 1/1961 | Presnick | 273/73 R |
| 4,145,047 A | * | 3/1979 | Nagamoto et al. | 273/73 G X |
| 4,196,901 A | * | 4/1980 | Durbin | 273/73 G |
| 4,280,699 A | * | 7/1981 | Drake | 273/73 D |
| 4,561,655 A | * | 12/1985 | Mortvedt | 273/73 C X |
| D290,487 S | * | 6/1987 | Mortvedt et al. | 273/73 C |
| 4,684,531 A | * | 8/1987 | Mortvedt | 273/73 D X |

FOREIGN PATENT DOCUMENTS

| | | | |
|---|---|---|---|
| AU | 238250 | 4/1962 | |
| AU | 282952 | 3/1967 | |
| AU | 456641 | 8/1973 | |
| AU | 495043 | 7/1976 | |
| AU | 47263/79 | 3/1980 | |
| AU | 75900/82 | 3/1983 | |
| AU | 49920/85 | 5/1987 | |
| FR | 1495578 | 8/1967 | |
| GB | 14798 | of 1904 | |
| GB | 267837 | 3/1927 | |
| GB | 941293 | 11/1963 | |
| GB | 941535 | 11/1963 | |
| GB | 1321235 | * 6/1973 | 273/73 H |
| GB | 990394 | 12/1979 | |
| GB | 1030767 | 5/1986 | |

OTHER PUBLICATIONS

July 1980 Tennis Magazine, pps. 36 and 78.

Reprint of 1878 Harpers Weekly sketch of lawn tennis game.

5 pages of literature from Wimbledon Lawn Tennis Museum (the "Demon" racquet; Jeffries and Mallings sphairistiké set; Evolution of the racquet; The Implements of Squash; 19th Century Badmonton Racquet.

Advance, Winsport, and Spin S–2 racquets.

Paragon advertisement, Dec. 8, 1987 Prince Squash Racquets.

* cited by examiner

*Primary Examiner*—Paul T. Sewell
*Assistant Examiner*—Vishu K. Mendiratta
(74) *Attorney, Agent, or Firm*—Skadden, Arps, Slate, Meagher & Flom, LLP

(57) ABSTRACT

A throatless squash racquet includes a hollow tubular frame, preferably of graphite, bent to form a head in which the outer portion is generally circular. The opposing legs of the tubular frame curve inwardly toward one another and then converge linearly. The converging legs continue to converge, but in an inverse curve, to define a narrow neck region, and merge into an elongated shaft. Because of its geometry, the racquet exhibits improved strength and durability.

10 Claims, 3 Drawing Sheets

THROATLESS SQUASH RACQUET

CROSS REFERENCE TO RELATED APPLICATIONS

This application is a continuation of application Ser. No. 08/004,173, filed on Jan. 13, 1993, which is a continuation of Ser. No. 07/746,140, filed Aug. 14, 1991, which is a continuation of Ser. No. 07/601,038, filed Oct. 23, 1990, which is a continuation of Ser. No. 07/309,246, filed Feb. 10, 1989, which is a continuation-in-part of Ser. No. 07/186, 971, Apr. 15, 1988. All have now been abandoned.

FIELD OF INVENTION

The subject of the present invention is a racquet for the game of squash.

BACKGROUND OF THE INVENTION

Squash is played in a court having three or four walls, with a rubber ball which is hit by alternate players toward the front wall. To play squash, the players use a racquet which comprises a head portion threaded with longitudinal and cross strings and a handle in the form of an elongated shaft extending from the head portion. The end of the handle is customarily provided with a grip made of a leather or synthetic wrap.

Because it is played in a relatively confined space, squash requires quick movement and reflexes. Ideally, a racquet needs to be built for a fast response and maximum reach. To achieve these ends, squash racquets are designed with a lightweight construction, a relatively small head (to reduce the movement of inertia), and a relatively long shaft. The inherent problem, however, of making a lightweight racquet with a long handle is breakage.

In the past, squash racquets were constructed of bent ash, in which the head section was formed into a closed circle and then a handle was secured thereto. Recently, squash racquets have been introduced in which the frames are made of carbon fiber-impregnated resins such as graphite or composites. In the case of graphite constructions, the racquet is made by bending a tubular layup of the fiber-impregnated resin material into a generally circular head portion with a pair of opposed converging legs projecting from the narrow region on the lower end thereof which merge to form an elongated shaft. A throat piece extends laterally between the opposed legs in the narrow neck region to close the bottom of the head portion.

When a racquet is strung, the strings exert an inward, compressive force on the head portion. The throat piece not only acts to anchor the lower end of the central longitudinal strings, but provides a brace for the opposed sides of the frame to counter-act the inward pull of the cross strings. However, the throat piece adds to the cost and labor of making the racquet, in that it requires separate fabrication and additional wrapping before being placed in the mold. It also adds weight to the frame, outward from the handle, increasing the moment of inertia (i.e. slowing the response time of the head). However, because of the breakage problem with graphite squash racquets, and in view of the structural support provided by the throat piece, it has heretofore been deemed necessary to make a commercially acceptable squash racquet.

SUMMARY OF THE INVENTION

The present invention is a throatless squash racquet having a frame preferably of fiber-impregnated resin material, e.g. graphite, in which, not only is weight reduced without a loss of strength or durability, but surprisingly the impact strength of the racquet is significantly improved compared to prior known graphite racquets.

More particularly, a squash racquet according to the invention includes a tubular profile frame, e.g. of a graphite layup. The tubular member is bent into a head, which the outer portion is generally circular and opposing legs of the tubular frame curve toward one another. The opposed legs continue to converge first linearly, and then in an inverse curve to define a neck portion, and thereafter merge to form an elongated shaft, the head and neck portion thus defining a teardrop shape, throatless stringing area. A grip is provided on the shaft.

The head and neck include holes for stringing. Because the center longitudinal strings are anchored in the neck, and are thus longer in length than in conventional squash racquets, it is preferable to compensate with a variable density string pattern.

Preferably, the height of the frame (the dimension perpendicular to the stringing plane) tapers in the transition region between the neck and shaft, so that the height of the shaft is less than the height of the head. Also, if desired the shaft may be formed with exterior slots to facilitate the attachment of the grip.

For a better understanding of the invention, reference is made to the accompanying detailed description of a preferred embodiment, taken in conjunction with he drawings forming a part of the application.

DETAILED DESCRIPTION OF A PREFERRED EMBODIMENT

Figure 1:
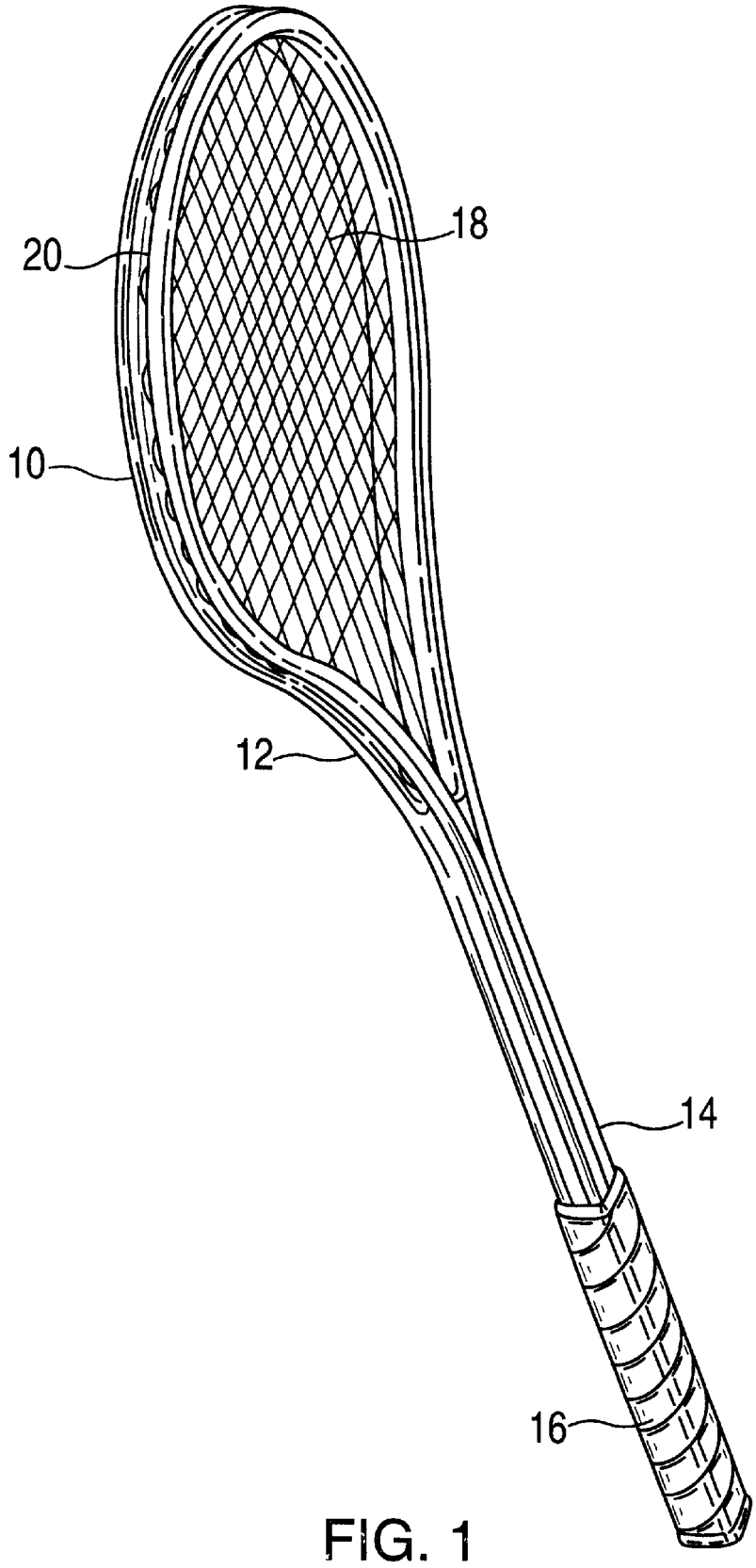
FIG. 1 is a perspective view of a squash racquet according to the present invention.

A squash racquet according to the present invention comprises a frame with curved head portion 10, a neck portion 12, and a shaft 14 formed from an elongated tubular element of a fiber-impregnated resin material. As used herein, the term "fiber-impregnated resin" refers to a frame utilizing such materials either alone or with other materials, as is known in the construction of composite racquets. Preferably, the frame is formed of graphite (carbon fiber-impregnated resin). A grip 16 of synthetic or other material is provided on the end of the shaft 14 in the customary manner. The head 10 and neck 12 support longitudinal and cross strings 20 in the manner described below.

The head 10 has a relatively small face, as is customary for squash racquets. The outer portion of the head is generally semicircular in shape, and opposed legs of the tubular profile curve inwardly toward region 22, where the opposing legs converge toward one another a short distance linearly. Thereafter, the opposed legs of the tubular profile continue converging gradually in an inverse curve, to define a narrow neck region 12, and finally meet at the base of the neck region and extend parallel to one another to define an elongated shaft 14. The head 10 and neck 12 thus define a teardrop shape, throatless stringing area for strings 20 that extends from the outer tip of the racquet to the base of the neck region 12. Preferably, the shaft 14 is longer than the combined length of the head 10 and neck 12, and the racquet has an overall length comparable to known squash racquets.

As shown in FIGS. 1, 3, 5, and 6, a stringing groove 20 is formed in the outwardly facing sidewall of the head 10 and neck 12, which includes a plurality of holes 24 for the strings 18. If desired, plastic grommet strips and a bumper strip (not shown) may be positioned in the grooves 20 to form bearing surfaces for the strings, in a known manner.

Figure 2:
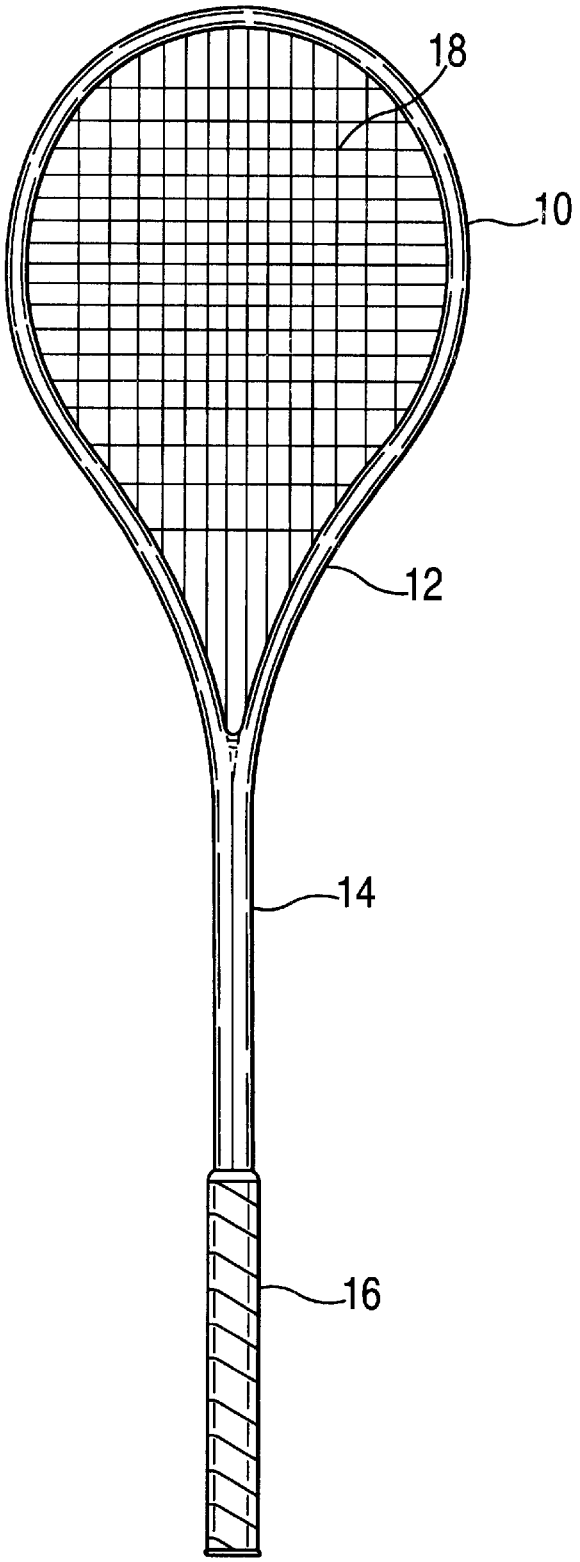
FIG. 2 is a front elevation view of the racquet of FIG. 1.
Figure 3:
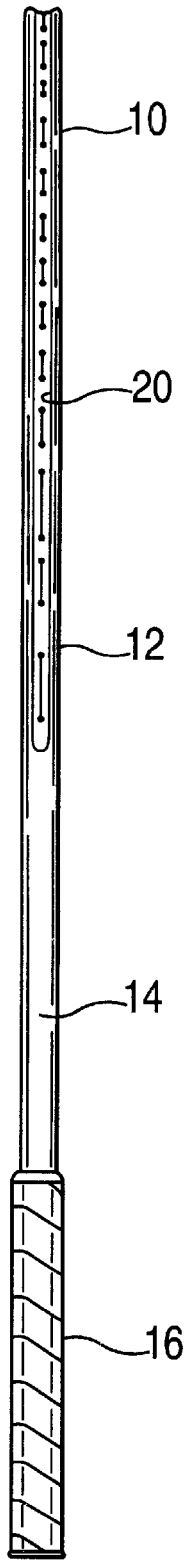
FIG. 3 is a side elevation view of the racquet of FIG. 1.
Figure 4:
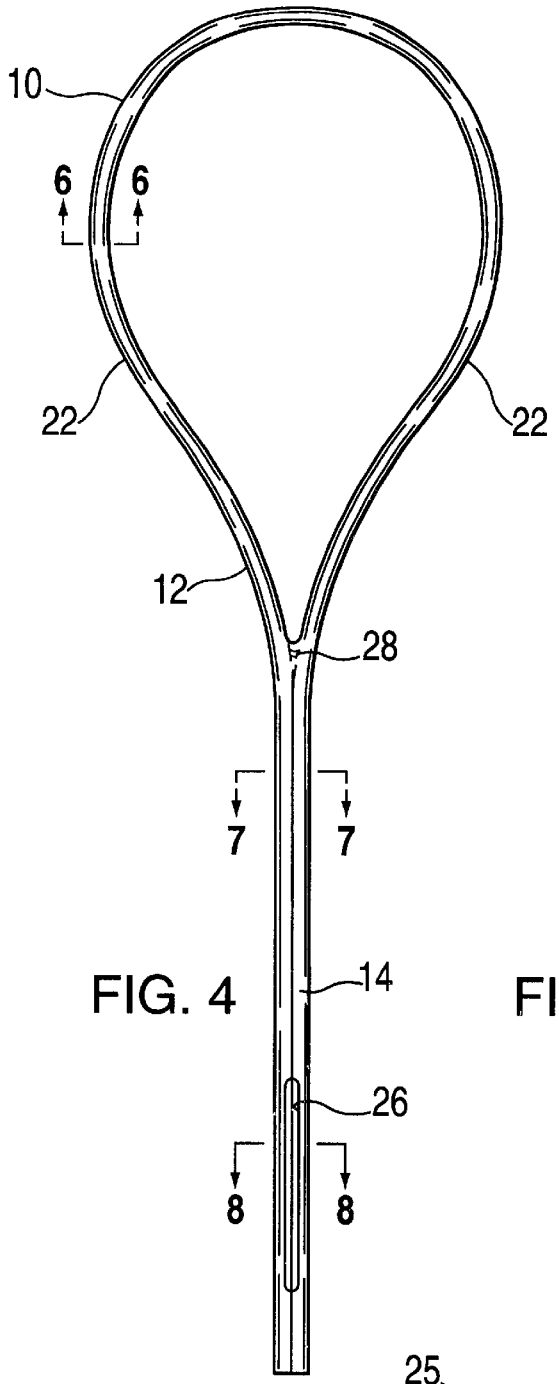
FIGS. 4 and 5 are front and side elevation views, respectively, of the frame of the racquet shown in FIG. 1.

As can be seen in FIG. 2, the center longitudinal strings extend downwardly to holes in the neck 12. Such strings are therefore substantially longer than the other strings, and preferably a variable density stringing pattern is employed, with the central longitudinal strings being spaced more closely together than the shorter longitudinal strings. In view of the fact that the lateral strings also differ from one another in length, a variable density stringing pattern may be employed there as well, with the center (i.e. longer) strings being spaced more closely together than the shorter strings.

Figure 5:
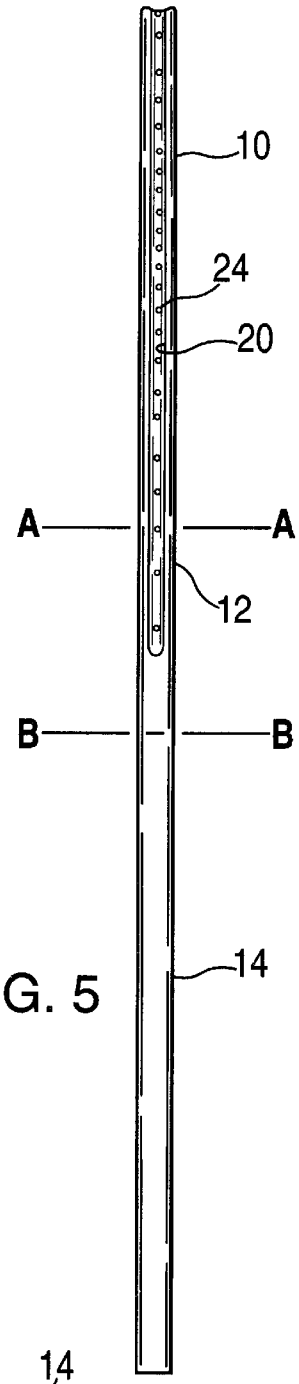
Figure 6:
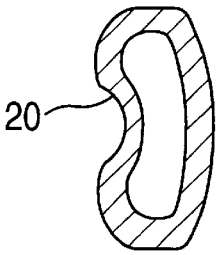
FIG. 6 is a sectional view of the frame, on an enlarged scale, taken through lines 6—6 of FIG. 4.
Figure 7:
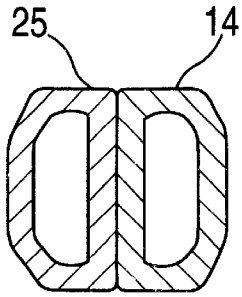
FIG. 7 is a sectional view of the frame, on an enlarged scale, taken through lines 7—7 of FIG. 4.
Figure 8:
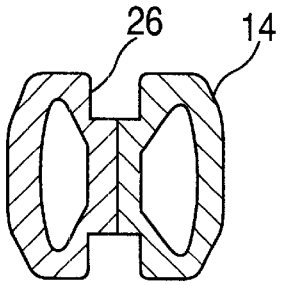
FIG. 8 is a sectional view of the frame, on an enlarged scale, taken through lines 8—8 of FIG. 4.

FIGS. 4–8 illustrate the frame, which is formed of a continuous tubular member. As shown in FIG. 6, the frame profile is hollow, with an outwardly facing stringing groove. The height of the profile (dimension perpendicular to the stringing plane) is approximately twice that of the width. Optionally, as shown in FIG. 5, the frame can taper in height in the transition region where the neck joins the shaft, starting in the area A—A of the neck and decreasing in height toward area B—B of the shaft, whereby the height of the frame is the racquet head 10 is greater than in the shaft.

Once the opposing legs of the tubular member meet at the shaft, they extend along a common wall 25 a distance longer than the head and neck portions 10, 12. If desired, one or more exterior slots 26 may be formed in the shaft, to facilitate the attachment of a grip 16. The formation of grips 16 on the shaft of a racquet is well known and need not be described here.

Racquet frames according to the invention may be formed of graphite in a process which is itself known. Sheets of uncured graphite material are rolled into the shape of an elongated, hollow tube that is placed into a mold having the shape shown in FIGS. 4–5. Additional graphite material may be positioned between the legs in the area 28 of the neck where the legs converge, in order to produce a more rounded appearance. Thereafter, the interior of the tubular member is pressurized, using an inflatable bladder or using other known techniques, to conform the member to the shape of the mold, and the frame is heated and cured.

The strings anchored in the neck extend at an acute angle relative to the neck, so that any lateral component of force exerted by the strings on the neck region is small. As a result, the racquet does not require a reinforcing throat piece as in known racquets.

EXAMPLE

Racquets according to the invention were subjected to impact testing for comparison with other known racquets.

The test racquets according to the invention were graphite, with an overall length of 683 mm, a stringing area of 309 m length 45% of the overall length of the racquet)× 184 mm width, and a shaft length of 364 mm. The neck 12 curved inversely at a radius of approximately 250 mm. The frame, in the head 10, had a height of 18 mm and an overall width of 9 mm, tapering, in the transition region A—A to B—B (lying approximately 266 mm and 366 mm, respectively, from the racquet tip), downwardly to a height of 15 mm. The width of the tubular members remained constant at 9 mm (18 mm overall in the shaft 14), and the frame had an average wall thickness of approximately 2 mm.

The test racquets according to the invention were strung with 14 longitudinal, and 17 cross strings. The four center longitudinal strings were spaced at a distance of 9.0 mm, with outward spacings thereafter of 9.5, 10, 11, 13 and 13 mm. As shown in FIG. 2, the two centermost longitudinal strings extend from the racquet tip substantially all the way to bhe base of the neck region 12. The two center cross strings were spaced a distance of 9.5 mm from one another, with strings above spaced at 10, 10, 11.5, 12, and 14 mm, and strings below spaced at 9.5, 9.5, 10.5, 11, 12, 13, 16, 17.5, and 18.5 mm.

Nine racquet samples according to the invention were tested against samples of known squash racquets having a throat piece. In the case of each sample, the grip end of the racquet was clamped in a test rig which then propelled the frame of the racquet against a rigid plate at a constant rate. The frame is impacted at the upper corner or at about 10 o'clock, so as to simulate the actual play conditions of a frame impacting a wall or the floor. The test was conducted for a maximum of 200 hits, or until the racquet failed, with the results as follows:

| Racquet | # samples tested | # samples to withstand 200 hits | average life to failure |
|---|---|---|---|
| Spectrum Composite | 5 | 0 | 78 |
| Graphite KS2 | 5 | 0 | 45 |
| Graphite Pro | 5 | 0 | 6 |
| Invention | 9 | 3 | 96 |

The racquet according to the invention thus exhibited a marked improvement in structural durability.

The foregoing is an example of a preferred embodiment according to the invention. Variations and modifications of the example disclosed herein will be apparent to persons skilled in the art, without departing from the inventive principles disclosed herein. All such modifications and variations are intended to be within the scope of the invention, as defined in the following claims.

I claim:

1. A squash racquet comprising:

a frame including at least one elongated, tubular frame member defining a head and a shaft that extends along a center axis; wherein the head defines a teardrop shape stringing area formed by an outer curved head portion, of substantially conventional size and shape, and a pair of legs that extend from the curved head portion, converge gradually toward the center axis in an inverse curve in a neck region, and meet at the base of the neck region; and a plurality of longitudinally extending main strings and a plurality of cross strings, wherein the main strings include a pair of center main strings, disposed on opposite sides of the center axis, that extend from the outer tip of the curved head portion substantially to the point where the legs meet, and wherein the length of the stringing area is approximately at least 45% of the overall length of the racquet such that the center main strings are substantially longer than in a conventional squash racquet.

2. A squash racquet according to claim 1, wherein the length of the stringing area is approximately 45% of the overall length of the racquet, and the shaft length is more than half the overall length of the racquet.

3. A squash racquet according to claim 2, wherein the radius of curvature of the legs in the neck region is approximately 250 mm.

4. A squash racquet according to claim 3, wherein the frame is made of a fiber-impregnated resin, and wherein the legs extend from the base of the neck region parallel to one another to define the shaft.

5. A squash racquet according to claim 4, wherein the head portion includes a straight portion adjoining the neck region where the opposite sides of the frame extend linearly.

6. A squash racquet according to claim 5, wherein the head portion includes an outer portion which is generally in the shape of a semicircle, and a second portion where opposite sides of the frame curve inwardly and join the straight portion.

7. A squash racquet according to claim 4, wherein the racquet has an overall length of approximately 683 mm and a shaft length of approximately 364 mm.

8. A squash racquet according to claim 7, wherein the racquet has a maximum width of approximately 184 mm.

9. A squash racquet according to claim 8, wherein the string holes are located so that the string density of the cross strings increases toward the widest part of the frame.

10. A squash racquet according to claim 1, wherein the head and neck region include string holes located so that the string density of the longitudinal strings increases toward the center of the frame.

* * * * *